US007147508B1

(12) United States Patent
Ju

(10) Patent No.: US 7,147,508 B1
(45) Date of Patent: Dec. 12, 2006

(54) ELECTRICAL CONNECTOR ASSEMBLY

(76) Inventor: Ted Ju, No. 15, Wu Shiun St., An-Lo Dist., Keelung City (TW)

( * ) Notice: Subject to any disclaimer, the term of this patent is extended or adjusted under 35 U.S.C. 154(b) by 0 days.

(21) Appl. No.: 11/330,127

(22) Filed: Jan. 12, 2006

(51) Int. Cl.
*H01R 13/52* (2006.01)

(52) U.S. Cl. ..... 439/521; 439/940; 439/135

(58) Field of Classification Search ..... 439/521, 439/940, 148, 135, 136, 144
See application file for complete search history.

(56) References Cited

U.S. PATENT DOCUMENTS 5,486,981 A * 1/1996 Blomquist ..... 361/704

6,219,241 B1 * 4/2001 Jones ..... 361/704

* cited by examiner

*Primary Examiner*—Ross Gushi
(74) *Attorney, Agent, or Firm*—Rosenberg, Klein & Lee

(57) ABSTRACT

An electrical connector assembly adapted to be mounted on a printed circuit board formed with several holes, comprises a connector structure including a dielectric body, a plurality of terminals each having a pin passing through the corresponding hole of the printed circuit board, accommodated in the dielectric body, a cover mounted on the connector structure, and a means for resisting vacuum suction, provided on the cover. Thus, the electrical connector assembly avoids damage caused by vacuum suction during the manufacturing process and the strength of the cover is therefore enhanced. Meanwhile, the efficiency of the manufacturing process is improved and the electrical connector assembly can be picked up manually.

13 Claims, 6 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly provided with a cover.

2. Description of the Prior Art

Conventional electrical connectors are generally classified into SMT (Surface Mounting Technology) types and DIP (Dual In-line Package) types. A DIP type connector is adapted to be mounted on a printed circuit board (referred to as a PCB hereinafter) and substantially comprises a top housing, a bottom housing, a dielectric body accommodated in the bottom housing, and a plurality of terminals each having a pin passing through the corresponding hole of the PCB, provided in the dielectric body. However, during the manufacturing process of an electrical connector errors commonly arise between the cover and the top housing, and between the top housing and the bottom housing. These errors cause larger errors among each and every terminal provided between the cover and the dielectric body.

On the other hand, SMT type connectors are automatically mounted at a predetermined position on a PCB via a vacuum suction machine. Automatic mounting is highly efficient. A solder ball can be melted to a preferred position due to an automatic adjustment that assures a proper relative position to the PCB therefrom.

The process for manufacturing a DIP type connector has no automatic adjustment for the melting solder ball. The task is performed manually and requires picking the finished connector up to prevent the pins of the terminals from being damaged when they are not able to be precisely inserted into the corresponding holes of the PCB. Furthermore, the cover used in a DIP type connector is the same as that used in an SMT type. Therefore, during the process for manufacturing a DIP type connector, chances are that the vacuum suction machine will pick up an incorrect connector, causing confusion and lowering the efficiency of the process.

Under the circumstances, the present invention is proposed to eliminate the drawbacks of the prior art, and provide an electrical connector assembly therefor.

SUMMARY OF THE INVENTION

An object of the present invention is to provide an electrical connector assembly that provides a means for resisting vacuum suction during a manufacturing process to improve the efficiency of the process.

According to the present invention, an electrical connector assembly adapted to be mounted on a PCB formed with several holes comprises: a connector structure including a dielectric body, a plurality of terminals each having a pin passing through the corresponding hole of the PCB, and accommodated in the dielectric body, a cover mounted on the connector, and a means for resisting vacuum suction provided on the cover.

Compared with the prior art, the electrical connector assembly avoids damage caused by vacuum suction during the manufacturing process and the strength of the cover is therefore enhanced. Meanwhile, the efficiency of the manufacturing process is improved and the electrical connector assembly can be picked up manually by an operator at the production line.

The invention will be better understood and objects other than those set forth above will become apparent when consideration is given to the following detailed description thereof.

DESCRIPTION OF THE PREFERRED EMBODIMENT

Figure 1:
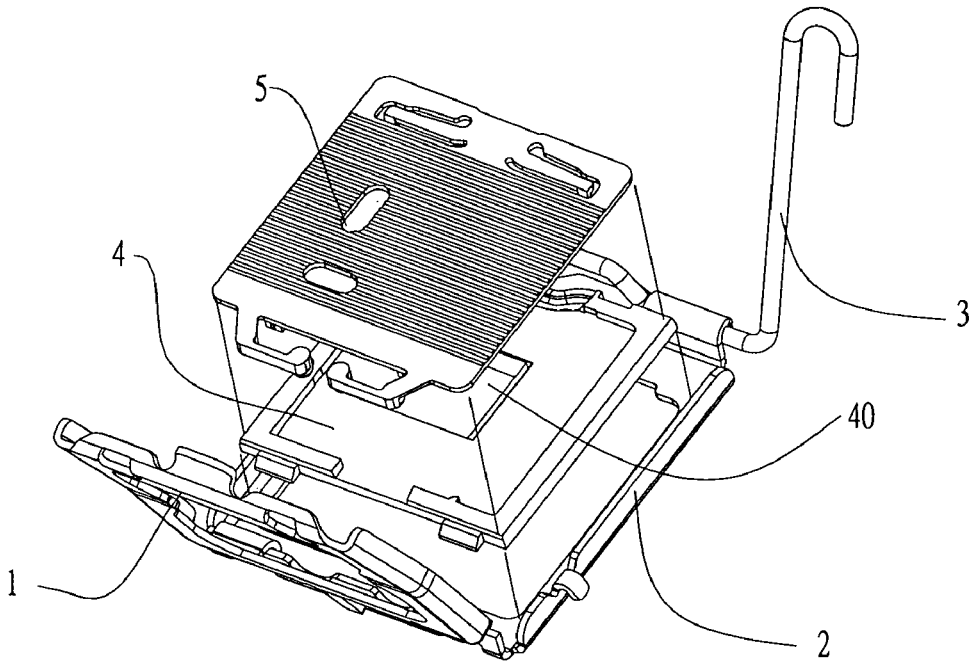
FIG. 1 is an exploded perspective view showing an electrical connector assembly in accordance with the present invention.
Figure 2:
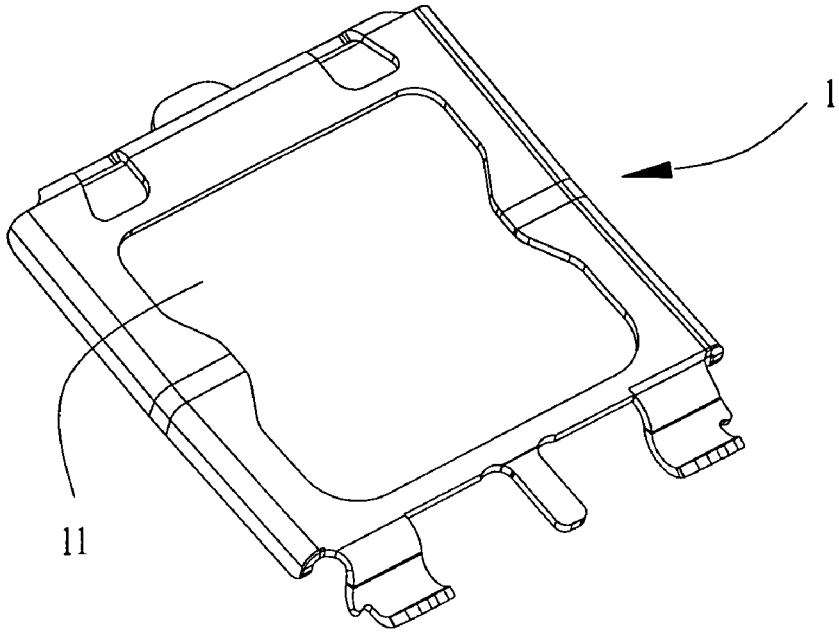
FIG. 2 is a perspective view showing a top housing of the electrical connector assembly shown in FIG. 1.
Figure 3:
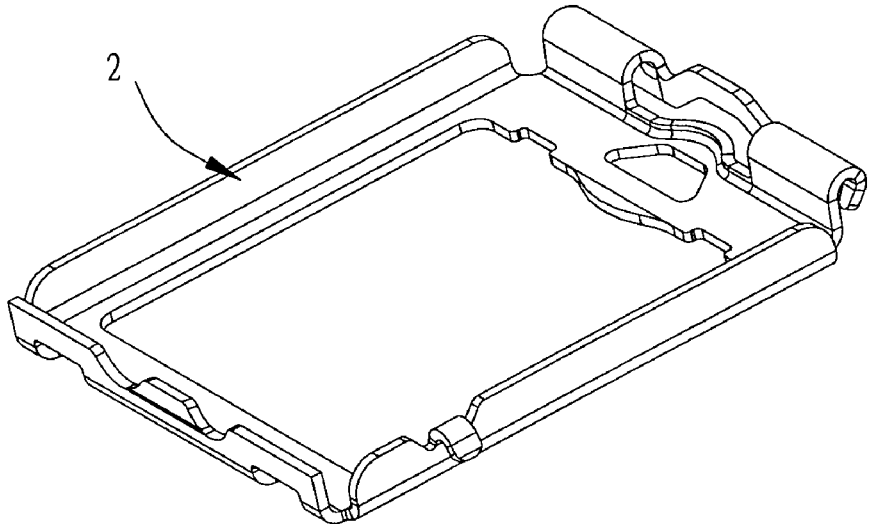
FIG. 3 is a perspective view showing a bottom housing of the electrical connector assembly shown in FIG. 1.
Figure 4:
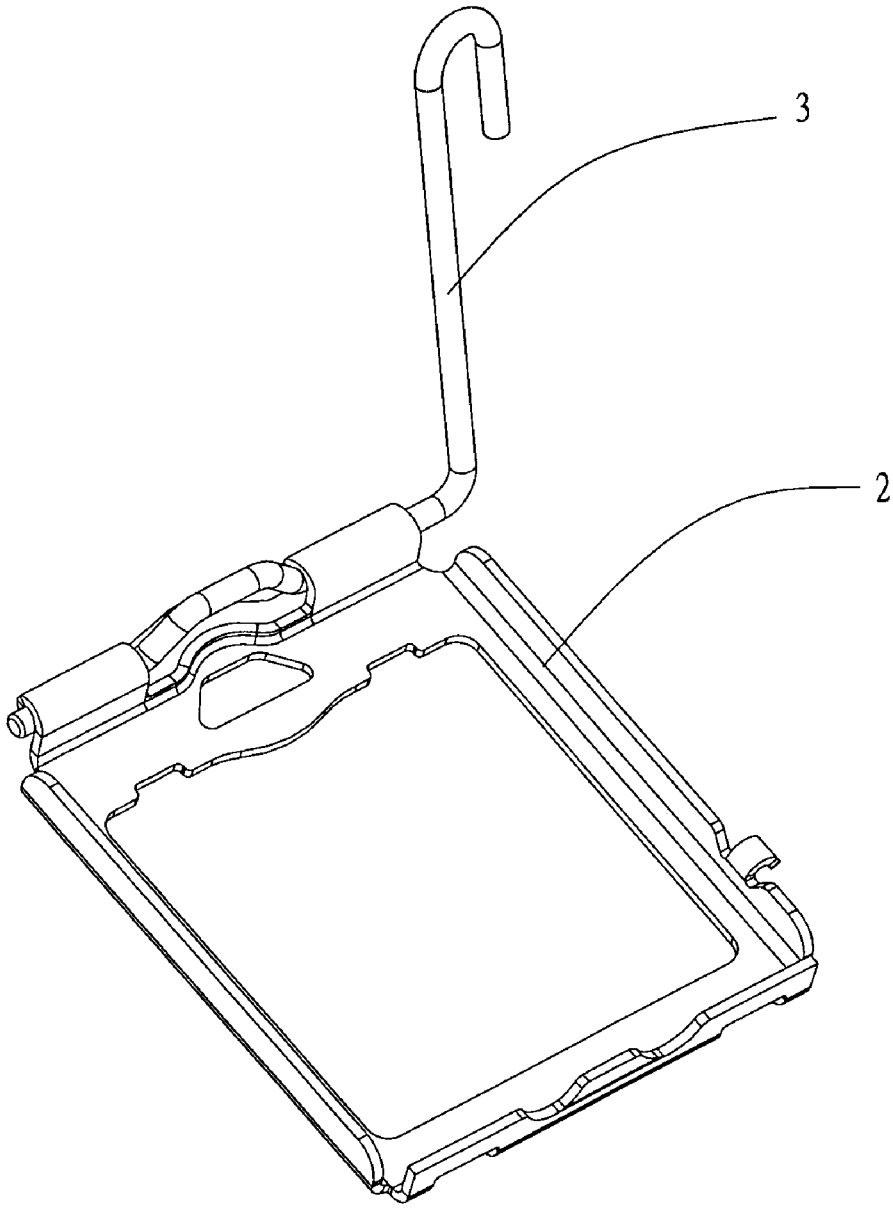
FIG. 4 is a perspective view showing a bar in connection with the bottom housing shown in FIG. 1.
Figure 5:
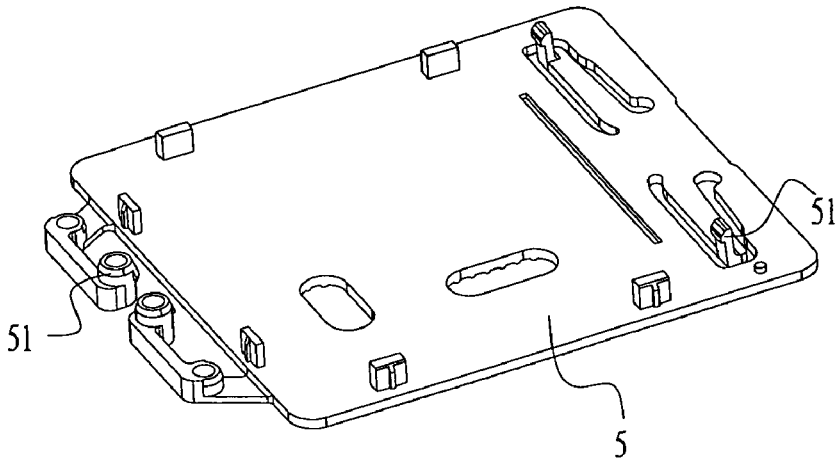
FIG. 5 is perspective view showing a cover of the electrical connector assembly shown in FIG. 1.
Figure 6:
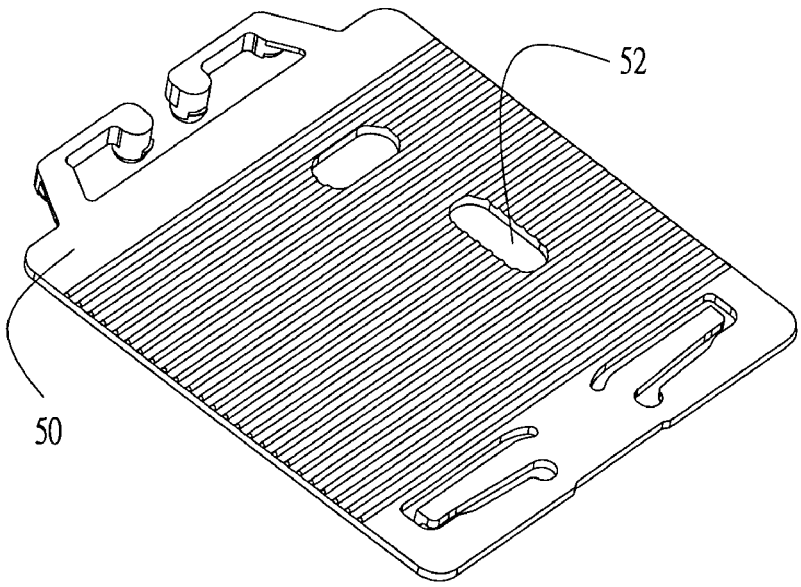
FIG. 6 is another perspective view showing the cover of the electrical connector assembly shown in FIG. 1 from a different viewing angle.

Referring to FIGS. 1 to 7, the electrical connector assembly according to a preferred embodiment of the present invention is adapted to be mounted on a PCB, and comprises a connector structure and a cover. The connector structure substantially comprises a top housing 1 and a bottom housing 2, a bar 3 for snapping both top housing 1 and the bottom housing 2 together, a dielectric body 4 and a plurality of terminals (not shown) are provided in the dielectric body 4. One end of each terminal is provided with a pin passing through the hole formed on the PCB.

The dielectric body 4 is centrally provided with a rectangular opening 40 (any other polygonal opening is also applicable), and the PCB is also formed with a rectangular positioning portion corresponding to such an opening 40. The cover 5 is formed with a hole 52 allowing an operator to see the neighboring sides of the above-mentioned positioning portion therethrough to assemble the electrical connector assembly precisely.

Figure 7A:
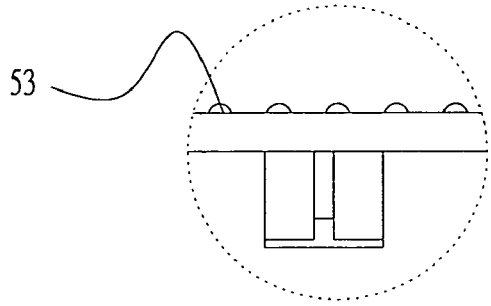
FIG. 7A is a partially enlarged view showing the circle A shown in FIG. 7.
Figure 7:
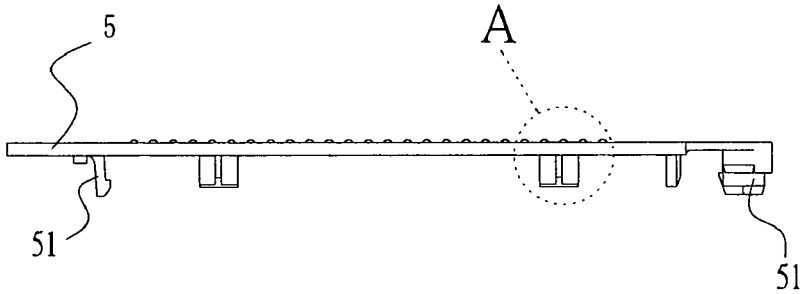
FIG. 7 is a side view showing the cover shown in FIG. 6.

The cover 5 is substantially a solid element and comprises a plate-like element 50 and a plurality of holding members 51 extending downwardly from the plate-like element 50. Those holding members are used to fasten the top housing 1 that is centrally provided with an opening 11 allowing the cover to overlie thereon to free the connector structure from dust and keep the terminals inside the connector structure clean. Additionally, the cover is provided with a means for resisting vacuum suction. In the embodiment, a plurality of ribs 53 provided on an upper surface of the cover 5 serve as a means for resisting vacuum suction, as shown in FIG. 7. Those ribs 53 prevent the entire electrical connector assembly from being sucked up by the vacuum during the manufacturing process. Thus, the electrical connector assembly avoids damage and the strength of the cover 5 is therefore enhanced. Meanwhile, the efficiency of the manufacturing process is improved and the electrical connector assembly can be picked up manually.

Figure 8:
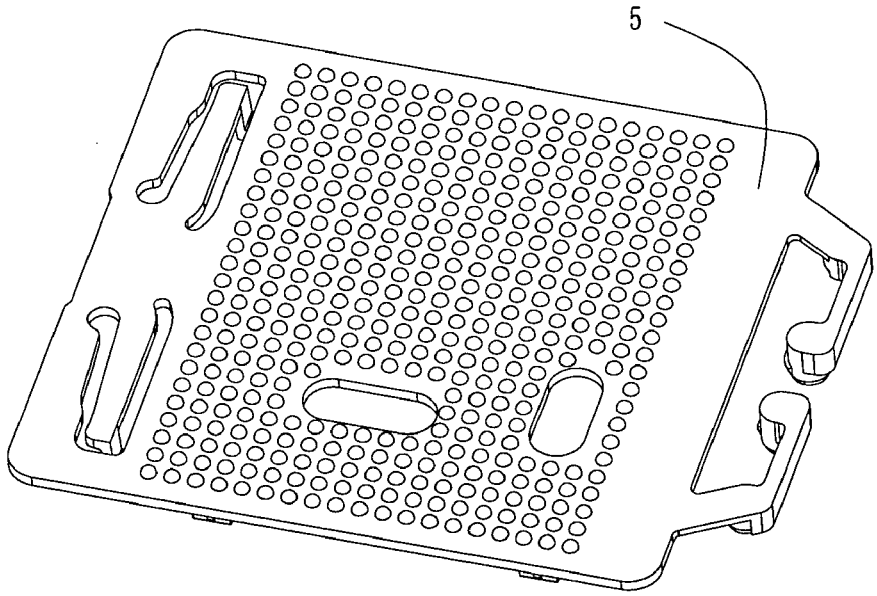
FIG. 8 is a perspective view showing another embodiment in accordance with the present invention.
Figure 9A:
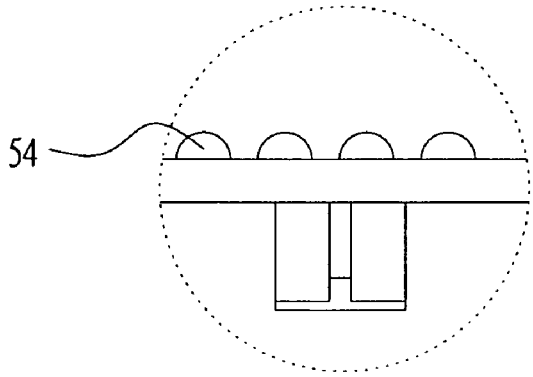
FIG. 9A is a partially enlarged view showing the circle A shown in FIG. 9.
Figure 9:
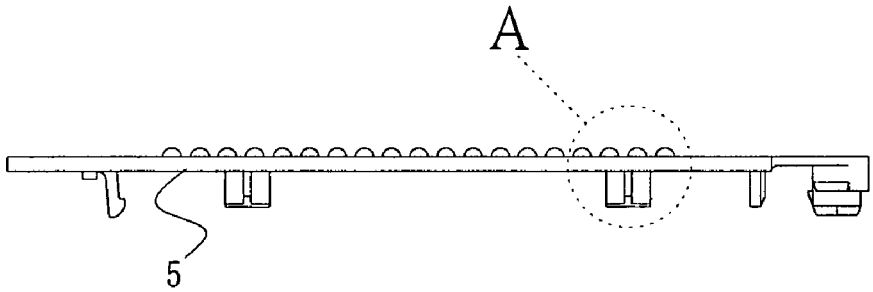
FIG. 9 is a side view showing the cover shown FIG. 8.

FIGS. 8 and 9 show a second embodiment of the present invention, the difference between this embodiment and the first resides in the means for resisting vacuum suction. The above-mentioned means for resisting vacuum suction is substantially constituted by a plurality of domed elements 54, as shown in FIG. 9A. Of course, either a plurality of dimpled elements 54 or an uneven upper surface of the cover can also serve as a means for resisting vacuum suction. Both aspects of the invention are applicable for preventing the entire electrical connector assembly from being sucked up by the vacuum during the manufacturing process. Thus, the electrical connector assembly avoids damage and the strength of the cover 5 is therefore enhanced. Meanwhile, the efficiency of the manufacturing process is improved and the electrical connector assembly can be picked up manually.

In view of the foregoing, the present invention is believed to be useful, novel and unobvious. Meanwhile, it should be noted that people skilled in the art can obtain various modifications without departing from the spirits and the scopes of the appended claims.

What is claimed is:

1. An electrical connector assembly adapted to be mounted on a printed circuit board formed with several holes, comprising:

a connector structure including a dielectric body, a plurality of terminals each having a pin passing through the corresponding hole of the printed circuit board, accommodated in the dielectric body;

a cover mounted on the connector structure; and means for resisting vacuum suction provided on the cover, said means for resisting vacuum suction including by a plurality of dimpled elements formed on the cover.

2. The electrical connector assembly according to claim 1, wherein the cover is substantially a solid element.

3. The electrical connector assembly according to claim 1, wherein the connector structure further comprises a top housing, a bottom housing connected with the top housing, a bar for locking both top and bottom housings, and the dielectric body being accommodated in the bottom housing.

4. The electrical connector assembly according to claim 3, wherein the top housing is centrally provided with an opening, and the cover overlies the opening of the top housing.

5. The electrical connector assembly according to claim 3, wherein the cover connects to the top housing by snapping.

6. An electrical connector assembly adapted to be mounted on a printed circuit board formed with several holes, comprising:

a connector structure including a dielectric body, a plurality of terminals each having a pin passing through the corresponding hole of the printed circuit board, accommodated in the dielectric body, the connector structure further including a top housing, a bottom housing connected with the top housing, a bar for locking both top and bottom housings, and the dielectric body being accommodated in the bottom housing;

a cover mounted on the connector structure; and means for resisting vacuum suction provided on the cover.

7. The electrical connector assembly according to claim 6, wherein the means for resisting vacuum suction is constituted by a plurality of ribs formed on the cover.

8. The electrical connector assembly according to claim 6, wherein the means for resisting vacuum suction is constituted by a plurality of domed elements formed on the cover.

9. The electrical connector assembly according to claim 6, wherein the means for resisting vacuum suction is an uneven surface formed on the cover.

10. The electrical connector assembly according to claim 6, wherein the cover is substantially a solid element.

11. The electrical connector assembly according to claim 6, wherein the dielectric body is centrally provided with a polygonal opening, a rectangular positioning portion corresponding to the opening is provided on the printed circuit board, and a hole allowing a person to see the neighboring sides of the positioning portion therethrough is provided on the cover.

12. The electrical connector assembly according to claim 6, wherein the top housing is centrally provided with an opening, and the cover overlies the opening of the top housing.

13. The electrical connector assembly according to claim 6, wherein the cover connects to the top housing by snapping.

* * * * *